US005670729A

United States Patent [19]

Miller et al.

[11] Patent Number: 5,670,729

[45] Date of Patent: Sep. 23, 1997

[54] VIRTUAL MUSIC INSTRUMENT WITH A NOVEL INPUT DEVICE

[75] Inventors: Allan A. Miller, Hollis; Vernon A. Miller, Mount Vernon, both of N.H.

[73] Assignee: Virtual Music Entertainment, Inc., Andover, Mass.

[21] Appl. No.: 439,435

[22] Filed: May 11, 1995

Related U.S. Application Data

[63] Continuation-in-part of Ser. No. 177,741, Jan. 5, 1994, Pat. No. 5,491,297, which is a continuation-in-part of Ser. No. 73,128, Jun. 7, 1993, Pat. No. 5,393,926.

[51] Int. Cl.[6] ..... G10H 1/26; G10H 3/06

[52] U.S. Cl. ..... 84/609; 84/639; 84/645

[58] Field of Search ..... 84/609–614, 634–638, 84/645, 639, 640, 477 R, 478, DIG. 6

[56] References Cited

U.S. PATENT DOCUMENTS 4,960,031 10/1990 Farrand .
5,074,182 12/1991 Capps et al. .
5,099,738 3/1992 Hotz .
5,146,833 9/1992 Lui .
5,393,926 2/1995 Johnson ..... 84/610

*Primary Examiner*—Stanley J. Witkowski
*Attorney, Agent, or Firm*—Fish & Richardson, P.C.

[57] ABSTRACT

A virtual musical instrument including a hand-held accessory of a type that is intended to be brought into contact with a musical instrument so as to play that instrument. The hand-held accessory includes a switch which, in response to the hand-held accessory being caused to strike another object by a person holding it, generates an activation signal. The musical instrument also includes an audio synthesizer; a memory storing a sequence of notes data structures for a musical score, each of the notes data structures representing a note or notes within said musical score and having an identified location in time relative to the other notes in the sequence; a timer; and a digital processor receiving the activation signal and generating a control signal therefrom. The digital processor is programmed (1) to use the timer to measure a time at which the activation signal is generated; (2) to use the measured time to select one of the notes data structures within the sequence; and (3) to generate the control signal, which causes the synthesizer to generate the note(s) represented by the selected notes data structure.

16 Claims, 8 Drawing Sheets

```
main ()
        {
 100 ~ system_initialization()
 102 ~ register_midi_callback(virtual_guitar_callback);
104 ~ while (continue)
        {
 106 ~ get_song_id_from_user();
 108 ~ set_up_data_structures(song_id);
 110 ~ initialize_data_structures(song_id);
 112 ~ play_song(song_id);
        }
        }
```

FIG. 5

```
play_song(song_id)
        {
 130 ~ announce_song_to_user();
 132 ~ wait_for_user_start_signal();
 134 ~ start_interleaved_audio_video(song_id);
        }
```

FIG. 6

```
virtual_guitar_callback()
        {
200     current_time = get_current_time();

202     event_type = get_guitar_string_event(&string_id, &string_velocity);

204     switch (event_type)

            case STRING_ON :

210             if (current_frame_idx != get_hframe(current_time)
                then
                    {
212                 current_frame_idx = get_hframe(current_time);

214                 start_tone_gen(string_velocity, string_id,
                                   lnotes_array[sframes[current_frame_idx].lnote_idx]);

215                 current_lead_note_idx = lnotes_array[sframes[
                                   current_frame_idx].lnote_idx]

216                 hnotes_played = 0;
                    }
218             else
                    {

220                 diff_time = current_time-last_time;

222                 if (diff_time< SIMULTAN_THRESHOLD)
                    then

224                     start_tone_gen(string_velocity, string_id,
                                   hnotes_array[current_lead_note_idx]
                                   .hnotes[hnotes_played++]);
```

FIG. 7A

```
                else
                    {
226 ~~~
```

```
struct sync_frame {
        TIMESTAMP_VALUE     frame_start_time;
        TIMESTAMP_VALUE     frame_end_time;
        int                 lnote_idx;
        }
```

FIG. 8

```
struct lead_note {
        int                 lead_note;
        TIMESTAMP_VALUE     time;
        }
```

FIG. 9

```
struct harmony_notes {
        int hnote_cnt;
        int hnotes[10];
        };
```

FIG. 10

VIRTUAL MUSIC INSTRUMENT WITH A NOVEL INPUT DEVICE

CROSS-REFERENCE TO RELATED APPLICATION

This application is a continuation-in-part of U.S. patent application Ser. No. 08/177,741, filed on Jan. 5, 1994, now issued as U.S. Pat. No. 5,491,297, and which is, in turn, a continuation-in-part of U.S. patent application Ser. No. 08/073,128, filed on Jun. 7, 1993 and now issued as U.S. Pat. No. 5,393,926.

BACKGROUND OF THE INVENTION

The invention relates to an actuator for a microprocessor-assisted musical instrument.

As microprocessors penetrate further into the marketplace, more products are appearing that enable people who have no formal training in music to actually produce music like a trained musician. Some instruments and devices that are appearing store the musical score in digital form and play it back in response to input signals generated by the user when the instrument is played. Since the music is stored in the instrument, the user need not have the ability to create the required notes of the melody but need only have the ability to recreate the rhythm of the particular song or music being played. These instruments and devices are making music much more accessible to everybody.

Among the instruments that are available, there are a number of mechanical and electrical toy products that allow the player to step through the single tones of a melody. The simplest forms of this are little piano shaped toys that have one or a couple of keys which when depressed advance a melody by one note and sound the next tone in the melody which is encoded on a mechanical drum. The electrical version of this ability can be seen in some electronic keyboards that have a mode called "single key" play whereby a sequence of notes that the player has played and recorded on the keyboard can be "played" back by pushing the "single key play" button (on/off switch) sequentially with the rhythm of the single note melody. Each time the key is pressed, the next note in the melody is played.

There was an instrument called a "sequential drum" that behaved in a similar fashion. When the drum was struck a piezoelectric pickup created an on/off event which a computer registered and then used as a trigger to sound the next tone in a melodic note sequence.

There are also recordings that are made for a variety of music types where a single instrument or, more commonly, the vocal part of a song is omitted from the audio mix of an ensemble recording such as a rock band or orchestra. These recordings available on vinyl records, magnetic tape, and CDS have been the basis for the commercial products known as MusicMinusOne and for the very popular karoeke that originated in Japan.

In the earlier patent (i.e., U.S. Pat. No. 5,393,926), we described a new instrument which we refer to as a virtual guitar. The virtual guitar includes a MIDI guitar, an audio synthesizer, a memory storing a musical score for the virtual guitar, and a digital processor which receives input signals from the MIDI guitar and uses those input signals to access notes of the stored musical score in memory. Since the melody notes are stored in a data file, the player of the virtual guitar need not know how to create the notes of the song. The player can produce or more accurately, access, the required sounds simply by strumming the MIDI guitar strings to generate activation signals. In addition, the system keeps track of where the user was supposed to be within the musical score even when the user stops strumming the strings. Thus, when the user resumes strumming the strings, the system generates the appropriate notes for that time in the song and as though the user had played to intervening notes.

SUMMARY OF THE INVENTION

The present invention is an improvement of the previously described virtual music instrument in that it is adapted to use a new input device.

In general, in one aspect, the invention is virtual musical instrument including a hand-held accessory of a type that is intended to be brought into contact with a musical instrument so as to play that instrument. The hand-held accessory includes a switch which, in response to the hand-held accessory being caused to strike another object by a person holding it, generates an activation signal. The instrument also includes an audio synthesizer; a memory storing a sequence of notes data structures for a musical score; a timer; and a digital processor receiving the activation signal from the hand-held accessory and generating a control signal therefrom. Each of the notes data structures within the stored sequence of notes represents a note or notes within the musical score and has an identified location in time relative to the other notes in the sequence of notes data structures. The digital processor is programmed to use the timer to measure a time at which the activation signal is generated. It is also programmed to use that measured time to select one of the notes data structures within the sequence of notes data structures, and it is programmed to generate the control signal which causes the synthesizer to generate the note(s) represented by the selected notes data structure.

Preferred embodiments include the following features. The hand-held accessory is a guitar pick including a housing defining an enclosed cavity with which the switch is mounted. The switch is a shock sensitive switch. In particular, the switch includes a first contact, a flexible metal strip, and a second contact located on a free end of the metal strip. The second contact touches the first contact when in a resting state. The switch further includes a second flexible metal strip at the free end of which the said first contact is located. The guitar pick also includes an integrated fin extending away from the housing.

Also in preferred embodiments, the sequence of notes data structures is partitioned into a sequence of frames, each of which contains a corresponding group of notes data structures of the sequence of notes data structures. Each frame further includes a time stamp identifying its time location within the musical score. The digital processor is programmed to identify a frame in the sequence of frames that corresponds to the measured time, and it is programmed to select one member of the group of notes data structures for the identified frame. The selected member is selected notes data structure.

One advantage of the invention is that the input device which accesses the capabilities of the virtual music system is much simpler, less expensive to make, easier to use, and is far more versatile as compared to more sophisticated input devices that were described in the previous patent (i.e., U.S. Pat. No. 5,393,926).

Other advantages and features will become apparent from the following description of the preferred embodiment, and from the claims.

BRIEF DESCRIPTION OF THE DRAWING

FIG. 5 shows a pseudocode representation of the main program loop;

FIG. 6 shows a pseudocode representation of the play_song( ) routine that is called by the main program lop;

FIGS. 7A and 7B show a pseudocode representation of the virtual_guitar_callback( ) interrupt routine that is installed during initialization of the system;

FIG. 8 shows the sync_frame data structure;

FIG. 9 shows the lead_note data structure;

FIG. 10 shows the harmony_notes data structure;

DESCRIPTION OF THE PREFERRED EMBODIMENTS

The present invention is an improvement on an invention which was described in U.S. Pat. No. 5,393,926 entitled Virtual Music System, filed Jun. 7, 1993 and incorporated herein by reference. The earlier invention employed a MIDI guitar which generates activation signals that are used by software to access notes of a song stored in memory. The improvement described herein is the use of a much simpler and more versatile input device for generating the activation signals that are used by the software. Instead of using a MIDI guitar, a guitar pick with an embedded activation device is used as the actuator. Before describing the pick and how it is used to generate the activation signals, the details of the virtual music system which uses the MIDI guitar will first be presented. With that as background, the modified input device (i.e., guitar pick) and the modifications which enable the pick to be used as the actuator will then be described.

The Virtual Music System

Figure 1:
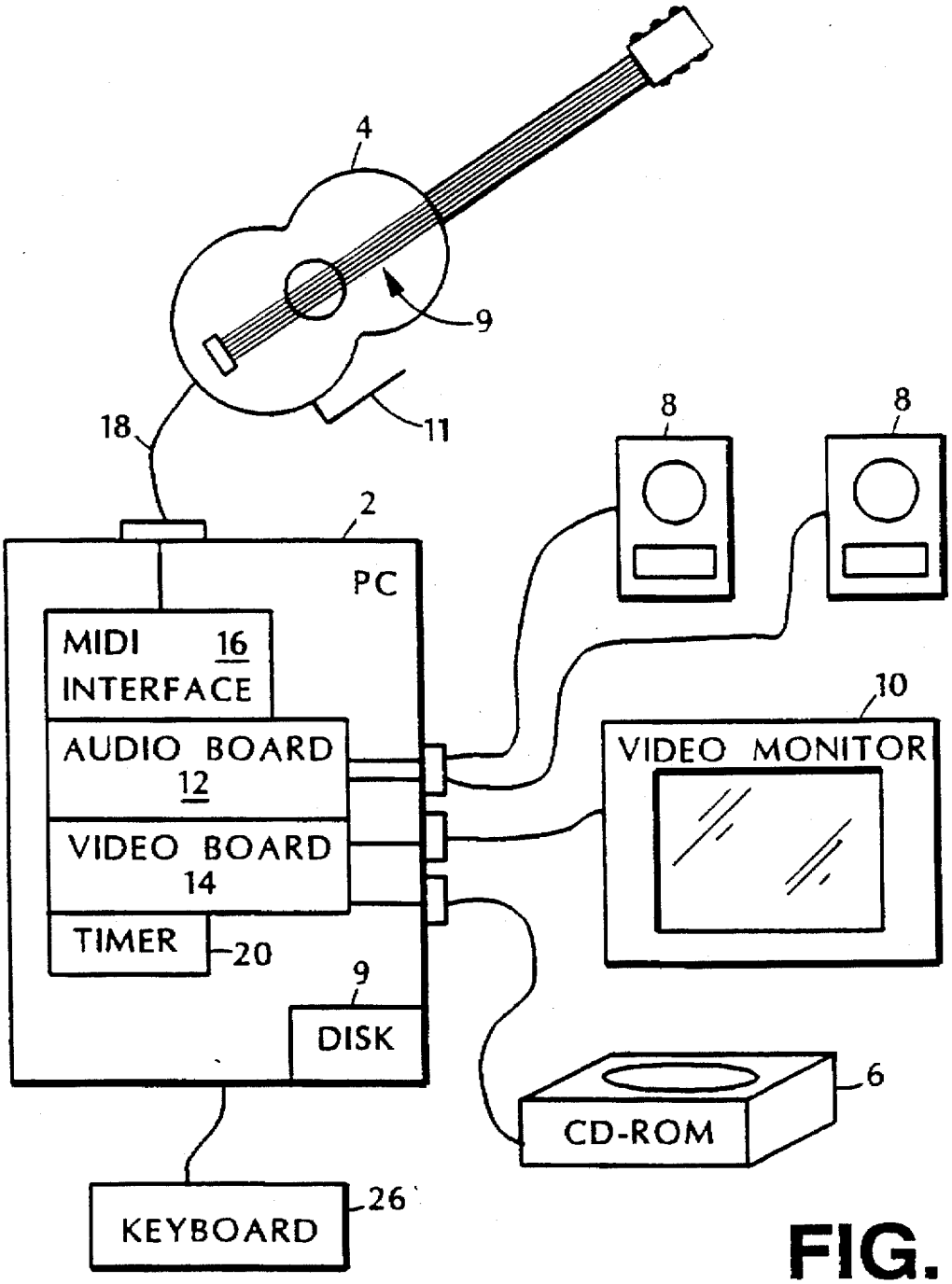
FIG. 1 is a block diagram of the virtual music system.

Referring to FIG. 1, the virtual music system includes among its basic components a Personal Computer (PC) 2; a virtual instrument, which in the described embodiment is a MIDI guitar 4; and a CD-ROM player 6. Under control of PC 2, CD-ROM player 6 plays back an interleaved digital audio and video recording of a song that a user has selected as the music that he also wishes to play on guitar 4. Stored in PC 2 is a song data file (not shown in FIG. 1) that contains a musical score that is to be played by MIDI guitar 4. It is, of course, for the guitar track of the same song that is being played on CD-ROM player 6.

MIDI guitar 4 is a commercially available instrument that includes a multi-element actuator, referred to more commonly as a set of strings 9, and a tremolo bar 11. Musical Instrument Digital Interface (MIDI) refers to a well known standard of operational codes for the real time interchange of music data. It is a serial protocol that is a superset of RS-232. When an element of the multi-element actuator (i.e., a string) is struck, guitar 4 generates a set of digital opcodes describing that event. Similarly, when tremolo bar 11 is used, guitar 4 generates an opcode describing that event. As the user plays guitar 4, it generates a serial data stream of such "events" (i.e., string activations and tremolo events) that are sent to PC 2 which uses them to access and thereby play back the relevant portions of the stored song in PC 2. PC 2 mixes the guitar music with the audio track from CD-ROM player and plays the resulting music through a set of stereo speakers 8 while at the same time displaying the accompanying video image on a video monitor 10 that is connected to PC 2.

Figure 2:
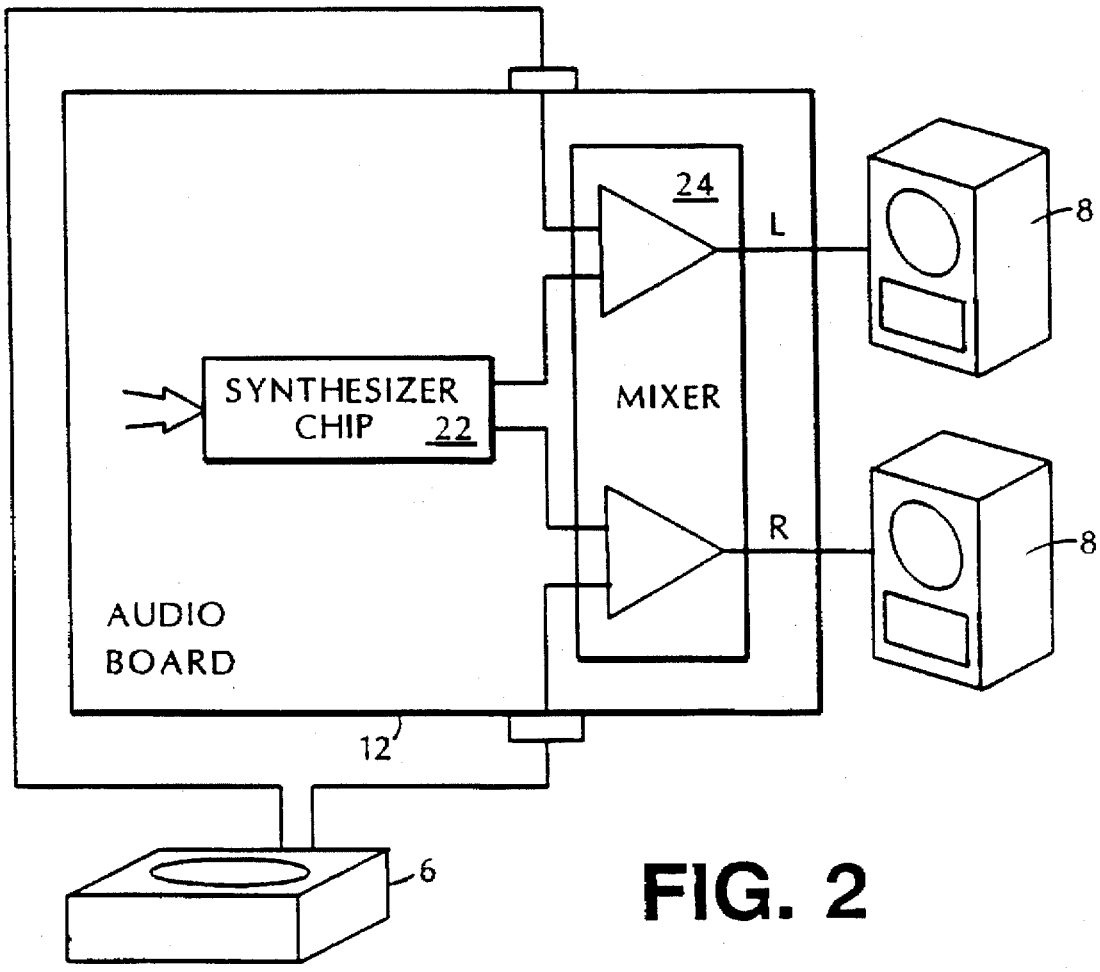
FIG. 2 is a block diagram of the audio processing plug-in board shown in FIG. 1.

PC 2, which includes a 80486 processor, 16 megabytes of RAM, and 1 gigabyte of hard disk storage 9, uses a Microsoft™ Windows 3.1 Operating System. It is equipped with several plug-in boards. There is an audio processing plug-in board 12 (also shown in FIG. 2) which has a built in programmable MIDI synthesizer 22 (e.g. a Proteus synthesis chip) and a digitally programmable analog 2 channel mixer 24. There is also a video decompression/accelerator board 14 running under Microsoft's VideoForWindows™ product for creating full-screen, full motion video from the video signal coming from CD-ROM player 6. And there is a MIDI interface card 16 to which MIDI guitar 4 is connected through a MIDI cable 18. PC 2 also includes a programmable timer chip 20 that updates a clock register every millisecond.

On audio processing plug-in board 12, Proteus synthesis chip 22 synthesizes tones of specified pitch and timbre in response to a serial data stream that is generated by MIDI guitar 4 when it is played. The synthesis chip includes a digital command interface that is programmable from an application program running under Windows 3.1. The digital command interface receives MIDI formatted data that indicate what notes to play at what velocity (i.e., volume). It interprets the data that it receives and causes the synthesizer to generate the appropriate notes having the appropriate volume. Analog mixer 24 mixes audio inputs from CD-ROM player 9 with the Proteus chip generated waveforms to create a mixed stereo output signal that is sent to speakers 8. Video decompression/accelerator board 14 handles the accessing and display of the video image that is stored on a CD-ROM disc along with a synchronized audio track. MIDI interface card 16 processes the signal from MIDI guitar 4.

When MIDI guitar 4 is played, it generates a serial stream of data that identifies what string was struck and with what force. This serial stream of data passes over cable 18 to MIDI interface card 16, which registers the data chunks and creates interrupts to the 80486. The MIDI Interface card's device driver code which is called as part of the 80486's interrupt service, reads the MIDI Interface card's registers and puts the MIDI data in an application program accessible buffer.

MIDI guitar 4 generates the following type of data. When a string is struck after being motionless for some time, a processor within MIDI guitar 4 generates a packet of MIDI formatted data containing the following opcodes:

MIDI_STATUS=On

MIDI_NOTE=<note number>

MIDI_VELOCITY=<amplitude>

The <note number> identifies which string was activated and the <amplitude> is a measure of the force with which the string was struck. When the plucked string's vibration decays to a certain minimum, then MIDI guitar 4 sends another MIDI data packet:

MIDI_STATUS=Off

MIDI_NOTE=<note number>

MIDI_VELOCITY=0 This indicates that the tone that is being generated for the string identified by <note number> should be turned off.

If the string is struck before its vibration has decayed to the certain minimum, MIDI guitar 4 generates two packets, the first turning off the previous note for that string and the second turning on a new note for the string.

The CD-ROM disc that is played on player 6 contains an interleaved and synchronized video and audio file of music which the guitar player wishes to play. The video track could, for example, show a band playing the music, and the audio track would then contain the audio mix for that band with the guitar track omitted. The VideoForWindows product that runs under Windows 3.1 has an API (Application Program Interface) that enables the user to initiate and control the running of these Video-audio files from a C program.

The pseudocode for the main loop of the control program is shown in FIG. 5. The main program begins execution by first performing system initialization (step 100) and then calling a register_midi_callback( ) routine that installs a new interrupt service routine for the MIDI interface card (step 102). The installed interrupt service effectively "creates" the virtual guitar. The program then enters a while-loop (step 104) in which it first asks the user to identify the song which will be played (step 106). It does this by calling a get_song_id_from_user( ) routine. After the user makes his selection using for example a keyboard 26 (see FIG. 1) to select among a set of choices that are displayed on video monitor 10, the user's selection is stored in a song_id variable that will be used as the argument of the next three routines which the main loop calls. Prior to beginning the song, the program calls a set_up_data_structures( ) routine that sets up the data structures to hold the contents of the song data file that was selected (step 108). The three data structures that will hod the song data are sframes[ ], lnote_array[ ], and hnotes_array[ ].

During this phase of operation, the program also sets up a timer resource on the PC that maintains a clock variable that is incremented every millisecond and it resets the millisecond clock variable to 0. As will become more apparent in the following description, the clock variable serves to determine the user's general location within the song and thereby identify which notes the user will be permitted to activate through his instrument. The program also sets both a current_frame_idx variable and a current_lead_note_idx variable to 0. The current_frame_idx variable, which is used by the installed interrupt routine, identifies the frame of the song that is currently being played. The current_lead_note_idx variable identifies the particular note within the lead_note array that is played in response to a next activation signal from the user.

Next, the program calls another routine, namely, initialize_data_structures( ), that retrieves a stored file image of the Virtual Guitar data for the chosen song from the hard disk and loads that data into the three previously mentioned arrays (step 110). After the data structures have been initialized, the program calls a play_song( ) routine that causes PC 2 to play the selected song (step 112).

Referring to FIG. 6, when play_song( ) is called, it first instructs the user graphically that it is about to start the song (optional) (step 130). Next, it calls another routine, namely, wait_for_user_start_signal( ), which forces a pause until the user supplies a command which starts the song (step 132). As soon as the user supplies the start command, the play_song routine starts the simultaneous playback of the stored accompaniment, i.e., the synchronized audio and video tracks on CD-ROM player 6 (step 134). In the described embodiment, this is an interleaved audio/video (.avi) file that is stored on a CD-ROM. It could, of course, be available in a number of different forms including, for example, a .WAV digitized audio file or a Red Book Audio track on the CD-ROM peripheral.

Since the routines are "synchronous" (i.e. do not return until playback is complete), the program waits for the return of the Windows Operating System call to initiate these playbacks. Once the playback has been started, every time a MIDI event occurs on the MIDI guitar (i.e., each time a string is struck), the installed MIDI interrupt service routine processes that event. In general, the interrupt service routine calculates what virtual guitar action the real MIDI guitar event maps to.

Figure 3:
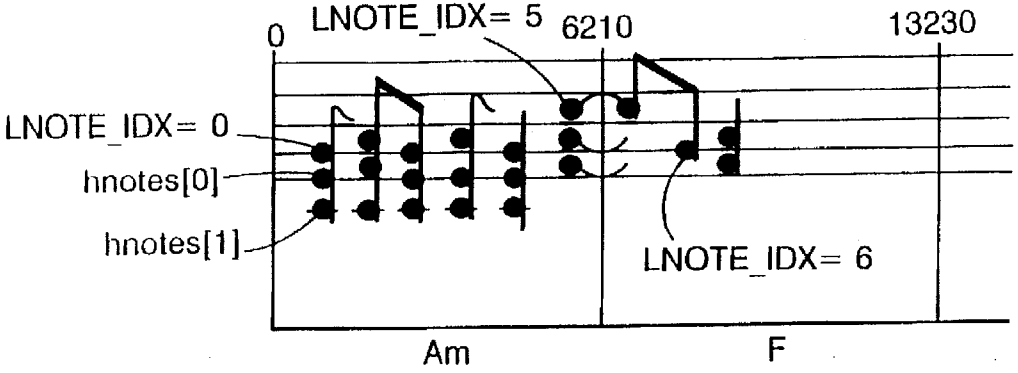
FIG. 3 illustrates the partitioning of a hypothetical musical score into frames.

Before examining in greater detail the data structures that are set up during initialization, it is useful first to describe the song data file and how it is organized. The song data file contains all of the notes of the guitar track in the sequence in which they are to be played. As illustrated by FIG. 3, which shows a short segment of a hypothetical score, the song data is partitioned into a sequence of frames 200, each one typically containing more than one and frequently many notes or chords of the song. Each frame has a start time and an end time, which locate the frame within the music that will be played. The start time of any given frame is equal to the end time of the previous frame plus 1 millisecond. In FIG. 3, the first frame extends from time 0 to time 6210 (i.e., 0 to 6.21 seconds) and the next frame extends from 6211 to 13230 (i.e., 6.211 to 13.23 seconds). The remainder of the song data file is organized in a similar manner.

In accordance with the invention, the guitar player is able to "play" or generate only those notes that are within the "current" frame. The current frame is that frame whose start time and end time brackets the current time, i.e., the time that has elapsed since the song began. Within the current frame, the guitar player can play any number of the notes that are present but only in the order in which they appear in the frame. The pace at which they are played or generated within the time period associated with the current frame is completely determined by the user. In addition, the user by controlling the number of string activations also controls both the number of notes of a chord that are generated and the number of notes within the frame that actually get generated. Thus, for example, the player can play any desired number of notes of a chord in a frame by activating only that number of strings, i.e., by strumming the guitar. If the player does not play the guitar during a period associated with a given frame, then none of the music within that frame will be generated. The next time the user strikes or activates a string, then the notes of a later frame, i.e., the new current frame, will be generated.

Note that the pitch of the sound that is generated is determined solely by information that is stored in the data structures containing the song data. The guitar player needs only activate the strings. The frequency at which the string vibrates has no effect on the sound generated by the virtual music system. That is, the player need not fret the strings while paying in order to produce the appropriate sounds.

It should be noted that the decision about where to place the frame boundaries within the song image is a somewhat subjective decision, which depends upon the desired sound effect and flexibility that is given to the user. There are undoubtedly many ways to make these decisions. Chord changes could, for example, be used as a guide for where to place frame boundaries. Much of the choice should be left to the discretion of the music arranger who builds the database. As a rule of thumb, however, the frames should probably not be so long that the music when played with the virtual instrument can get far out of alignment with the accompaniment and they should not be so short that the performer has no real flexibility to modify or experiment with the music within a frame.

For the described embodiment, an ASCI editor was used to create a text based file containing the song data. Generation of the song data file can, of course, be done in many other ways. For example, one could produce the song data file by first capturing the song information off of a MIDI instrument that is being played and later add frame delimiters in to that set of data.

Figure 4:
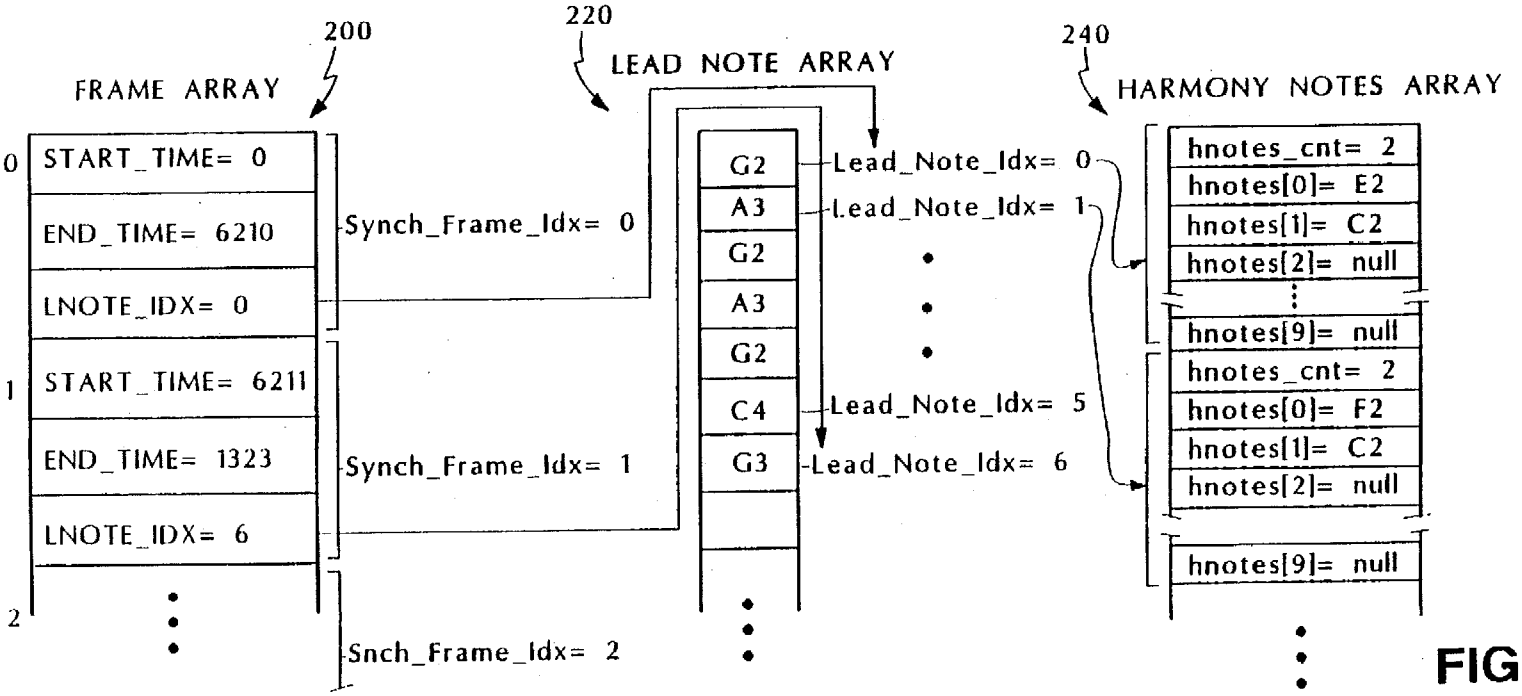
FIG. 4 shows the sframes[ ], lnote_array[ ], and hnotes_array[ ] data structures and their relationship to one another.

With this overview in mind, we now turn to a description of the previously mentioned data structures, which are shown in FIG. 4. The sframes[ ] array 200, which represents the sequence of frames for the entire song, is an array of synch_frame data structures, one of which is shown in FIG. 8. Each synch_frame data structure contains a frame_start_time variable that identifies the start time for the frame, a frame_end_time variable that identifies the send time of the frame and a lnote_idx variable that provides an index into both a lnote_array[ ] data structure 220 and an hnotes_array[ ] data structure 240.

The lnote_array[ ] 220 is an array of lead_note data structures, one of which is shown in FIG. 9. The lnote_array[ ] 220 represents a sequence of single notes (referred to as "lead notes") for the entire song in the order in which they are played. Each lead_note data structure represents a singly lead note and contains two entries, namely, a lead_note variable that identifies the pitch of the corresponding lead note, and a time variable, which precisely locates the time at which the note is supposed to be played in the song. If a single note is to be played at some given time, then that note is the lead note. If a chord is to be played at some given time, then the lead note is one of the notes of that chord and hnote_array[ ] data structure 240 identifies the other notes of the chord. Any convention can be used to select which note of the chord will be the lead note. In the described embodiment, the lead note is the chord note with the highest pitch.

The hnote_array[ ] data structure 240 is an array of harmony_note data structures, one of which is shown in FIG. 10. The lnote_idx variable is an index into this array. Each harmony_note data structure contains an hnote_cnt variable and an hnotes[ ] array of size 10. The hnotes[ ] array specifies the other notes that are to be played with the corresponding lead note, i.e., the other notes in the chord. If the lead note is not part of a chord, the hnotes[ ] array is empty (i.e., its entries are all set to NULL). The hnote_cnt variable identifies the number of non-null entries in the associated hnotes[ ] array. Thus, for example, if a single note is to be played (i.e., it is not part of a chord), the hnote_cnt variable in the harmony_note data structure for that lead note will be set equal to zero and all of the entries of the associated hnotes[ ] array will be set to NULL.

As the player hits strings on the virtual guitar, the Callback routine which will be described in greater detail in next section is called for each event. After computing the harmonic frame, chord index and sub-chord index, this callback routine instructs the Proteus Synthesis chip in PC 2 to create a tone of the pitch that corresponds to the given frame, chord, sub-chord index. The volume of that tone will be based on the MIDI velocity parameter received with the note data from the MIDI guitar.

Virtual Instrument Mapping

FIGS. 7A and 7B show pseudocode for the MIDI interrupt callback routine, i.e., virtual_guitar_callback( ). When invoked the routine invokes a get_current_time( ) routine which uses the timer resource to obtain the current time (step 200). It also calls another routine, i.e., get_guitar_string_event(&string_id, &string_velocity), to identify the event that was generated by the MIDI guitar (step 202). This returns the following information: (1) the type of event (i.e., ON, OFF, or TREMOLO control); (2) on which string the event occurred (i.e. string_id); and (3) if an ON event, with what velocity the string was struck (i.e. string_velocity).

The interrupt routine contains a switch instruction which runs the code that is appropriate for the event that was generated (step 204). In general, the interrupt handler maps the MIDI guitar events to the tone generation of the Proteus Synthesis chip. Generally, the logic can be summarized as follows:

If an ON STRING EVENT has occurred, the program checks whether the current time matches the current frame (210). This is done by checking the timer resource to determine how much time on the millisecond clock has elapsed since the start of the playback of the Video/Audio file. As noted above, each frame is defined as having a start time and an end time. If the elapsed time since the start of playback falls between these two times for a particular frame then that frame is the correct frame for the given time (i.e., it is the current frame). If the elapsed time falls outside of the time period of a selected frame, then it is not the current frame but some later frame is.

If the current time does not match the current frame, then the routine moves to the correct frame by setting a frame variable i.e., current_frame_idx, to the number of the frame whose start and end times bracket the current time (step 212). The current_frame_idx variable serves as an index into the sframe_array. Since no notes of the new frame have yet been generated, the event which is being processed maps to the first lead note in the new frame. Thus, the routine gets the first lead note of that new frame and instructs the synthesizer chip to generate the corresponding sound (step 214). The routine which performs this function is start_tone_gen( ) in FIG. 7A and its arguments include the string_velocity and string_id from the MIDI formatted data as well as the identity of the note from the lnotes_array. Before exiting the switch statement, the program sets the current_lead_note_idx to identify the current lead note (step 215) and it initializes an hnotes_played variable to zero (step 216). The hnotes_played variable determines which note of a chord is to be generated in response to a next event that occurs sufficiently close in time to the last event to qualify as being part of a chord.

In the case that the frame identified by the current_frame_idx variable is not the current frame (step 218), then the interrupt routine checks whether a computed difference between the current time and the time of the last ON event, as recorded in a last_time variable, is greater than a preselected threshold as specified by a SIMULTAN_THRESHOLD variable (steps 220 and 222). In the described embodiment, the preselected time is set to be of sufficient length (e.g on the order of about 20 milliseconds) so as to distinguish between events within a chord (i.e., approximately simultaneous events) and events that are part of different chords.

If the computed time difference is shorter than the preselected threshold, the string ON event is treated as part of a "strum" or "simultaneous" grouping that includes the last lead note that was used. In this case, the interrupt routine, using the lnote_idx index, finds the appropriate block in the harmony_notes array and, using the value of the hnotes_played variable, finds the relevant entry in h_notes array of that block. It then passes the following information to the synthesizer (step 224):

```
string_velocity
string_id
hnotes_array [current_lead_note_idx].hnotes [hnotes_
    played++]
```

which causes the synthesizer to generate the appropriate sound for that harmony note. Note that the hnotes_played variable is also incremented so that the next ON event, assuming it occurs within a preselected time of the last ON event, accesses the next note in the hnote[ ] array.

If the computed time difference is longer than the preselected threshold, the string event is not treated as part of a chord which contained the previous ON event; rather it is mapped to the next lead note in the lead_note array. The interrupt routine sets the current_lead_note_idx index to the next lead note in the lead_note array and starts the generation of that tone (step 226). It also resets the hnotes_played variable to 0 in preparation for accessing the harmony notes associated with that lead note, if any (step 228).

If the MIDI guitar event is an OFF STRING EVENT, then the interrupt routine calls an unsound_note( ) routine which turns off the sound generation for that string (step 230). It obtains the string_id from the MIDI event packet reporting the OFF event and passes this to the unsound_note( ) routine. The unsound_note routine then looks up what tone is being generated for the ON Event that must have preceded this OFF event on the identified string and turns off the tone generation for that string.

If the MIDI guitar event is a TREMOLO event, the tremolo information from the MIDI guitar gets passed directly to synthesizer chip which produces the appropriate tremolo (step 232).

The Input Device

Figure 11A:
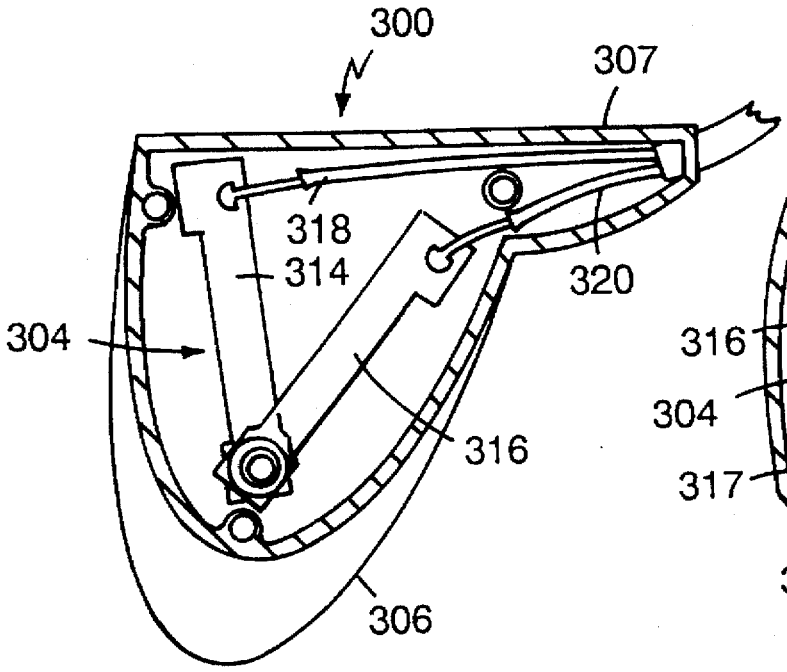
FIGS. 11A and B are two views of a guitar pick which contains a shock sensitive switch.
Figure 11B:
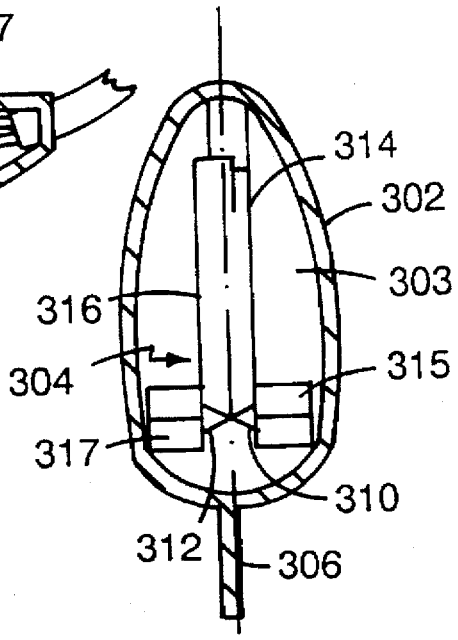

In the invention described herein, a guitar pick with an internal shock sensitive switch is substituted for the MIDI guitar. The pick 300, which is shown in FIGS. 11A and B, includes a plastic housing 302 with a hollow interior 303 in which is mounted a shock sensitive switch 304. On the outside perimeter of the enclosed housing there is an integrated plastic fin 306 which acts as the pick element. At one end of housing 302 there is a strain relief portion 307 extending away from the housing.

Shock sensitive switch 304 is any device which senses deceleration such as will occur when the user brings the pick into contact with an object. In the described embodiment, switch 304 includes two contacts 310 and 312, each located at the end of a corresponding flexible arms 314 and 316, respectively. The arms are made of a metal such as spring steel and are arranged so as to bias the contacts in a closed position when in a resting state. Also attached to the arms 314 and 316 at their frees ends on the sides opposite from the contacts 310 and 312 are weights 315 and 317. The inertia of the weights 315 and 317 cause the spring arms 314 and 316 to flex when the pick experiences either acceleration or deceleration (e.g. a shock caused by striking the pick against another object).

Connected to arms 314 and 316 are wires 318 and 320 that pass through the strain relief portion at the end of the housing and connect to the computer, e.g. where the MIDI guitar was connected.

Figure 12:
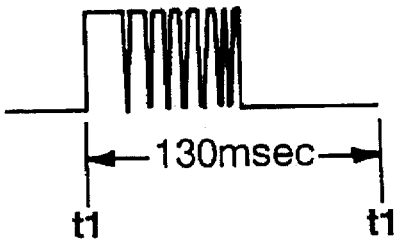
FIG. 12 shows a characteristic output signal of the guitar pick.

When the pick is swept across the strings of a guitar or, for that matter, across any object, arms 314 and 316 of the shock sensitive switch inside of the pick flex away from their static rest positions and in so doing they separate and create an open circuit thereby causing the resistance between the contacts to increase substantially. When the spring arms return the contacts to their rest positions, the contacts will repeatedly bounce against each other until they finally come back to their rest positions. The MIDI interface circuit sees a voltage signal across the output lines of the switch that oscillates between zero when the contacts are shorted and some positive voltage when the contacts are open, as shown in FIG. 12.

The MIDI interface board detects the first opening of the switch (i.e., the transition from zero to some positive voltage) as an event and generates an interrupt which invokes the previously described interrupt routine. The software is modified from that which is used for the MIDI guitar to perform a debouncing function on the input signal which prevents or disables the generation of any further interrupts for a predetermined period after the first interrupt. In the described embodiment, the predetermined period is about 150 msec. During this period, the MIDI interface board ignores any subsequent events which are generated by the switch because of the oscillation that is occurring at the switch contacts.

Since the only input signal that is generated by the guitar pick is the single signal that is produced by the opening and closing of the switch, the MIDI interface board is modified in this embodiment to generate the MIDI signals that would normally be received from the MIDI guitar when all of the strings are activated. That is, for each string_id, the MIDI interface generates an ON event and it sets the string_velocity to some predefined value. To the system, it appears that the user has strummed all six strings of a guitar with the same force.

After the short delay period has elapsed (i.e., 150 msec), the software is ready to detect the next activation event by the user. After a longer delay period the MIDI interface generates OFF events for each of the strings that have been activated.

In all other ways the system operates just as the previously described embodiment which used the MIDI guitar. In other words, the modified guitar pick enables the user to access the capabilities of the previously described virtual instrument without having to use, or even own, a MIDI guitar. A simple tennis racket will do as the object against which the guitar pick can be strummed. In fact, if the bias of the arms within the switch is sufficiently light it is possible to cause the generation of an event simply by performing the action of playing a completely imaginary guitar (i.e., an "air" guitar). That is, the acceleration and/or deceleration of the pick caused by pretending to play an imaginary guitar will be sufficient to cause the contacts to open.

In the shock sensitive switch described above, the contacts were normally closed. A shock sensitive switch having contacts which are normally open could just as well have been used. In addition, other types of shock sensitive switch (e.g. an accelerometers) could have been used. Moreover, it should also be understood that an entirely different type of switch could be used. For example, it is possible to use a simple contact switch which detects whenever the user contacts an object with the guitar pick.

Moreover, the concept can be readily extended to other instruments which use and/or can be modified to use hand-held accessories like the guitar pick. For example, drum sticks can be modified by adding a shock sensitive switch to the stick which generates a drum event whenever it is struck against another object. Or in the case of a piano, the user can wear gloves which have one or more switches mounted in the glove fingers. Every time the user pretends to play a piano by making the appropriate finger movements, the switches will generate piano or key events and this will access the notes of the stored music through the software as previously described.

Having thus described illustrative embodiments of the invention, it will be apparent that various alterations, modifications and improvements will readily occur to those skilled in the art. Such obvious alterations, modifications and improvements, though not expressly described above, are nonetheless intended to be implied and are within the spirit and scope of the invention. Accordingly, the foregoing discussion is intended to be illustrative only, and not limiting; the invention is limited and defined only by the following claims and equivalents thereto.

What is claimed is:

1. A virtual musical instrument comprising:

a hand-held accessory of a type that is intended to be brought into contact with a musical instrument so as to play that instrument, said hand-held accessory including a switch which, in response to said hand-held accessory being caused to strike another object by a person holding said hand-held accessory, generates an activation signal;

an audio synthesizer;

a memory storing a sequence of notes data structures for a musical score, each of said notes data structures representing a note or notes within said musical score and having an identified location in time relative to the other notes in said sequence of notes data structures;

a timer; and a digital processor receiving said activation signal from said hand-held accessory and generating a control signal therefrom, said digital processor programmed to use said timer to measure a time at which said activation signal is generated, said digital processor programmed to use said measured time to select one of the notes data structures within said sequence of notes data structures, and said digital processor programmed to generate said control signal, wherein said control signal causes said synthesizer to generate the note(s) represented by said selected notes data structure.

2. The virtual instrument of claim 1 wherein said hand-held accessory is a guitar pick comprising a housing defining an enclosed cavity with said switch mounted therein, said switch being a shock sensitive switch.

3. The virtual instrument of claim 2 wherein said switch comprises a first contact, a flexible metal strip, and a second contact located on a free end of said metal strip, said second contact touching said first contact when in a resting state.

4. The virtual instrument of claim 3 wherein said switch further comprises a second flexible metal strip, and wherein said first contact is located at a free end of said second metal strip.

5. The virtual instrument of claim 2 wherein said guitar pick further comprises an integrated fin extending away from said housing.

6. The virtual instrument of claim 1 wherein said sequence of notes data structures is partitioned into a sequence of frames, each frame of said sequence of frames containing a corresponding group of notes data structures of said sequence of notes data structures and wherein each frame of said sequence of frames has a time stamp identifying its time location within said musical score, and wherein said digital processor is programmed to identify a frame in said sequence of frames that corresponds to said measured time, and said digital processor is programmed to select one member of the group of notes data structures for the identified frame, said selected member being said selected notes data structure.

7. The virtual musical instrument of claim 1 further comprising an audio playback component for storing and playing back an audio track associated with said musical score, and wherein said digital processor starts both said timer and said audio playback component at the same time so that the notes generated by the synthesizer are synchronized with the playback of said audio track.

8. The virtual musical instrument of claim 7 wherein said audio track omits a music track, said omitted music track being said musical score for said hand-held accessory.

9. The virtual musical instrument of claim 7 further comprising a video playback component for storing and playing back a video track associated with said stored musical score, and wherein said digital processor starts both said timer and said video playback component at the same time so that the notes generated by the synthesizer are synchronized with the playback of said video track.

10. The virtual musical instrument of claim 9 wherein both the audio and video playback component comprise a CD-ROM player.

11. The virtual musical instrument of claim 1, wherein said hand-held accessory is a drum stick.

12. The virtual musical instrument of claim 11, wherein said switch comprises a contact switch.

13. The virtual musical instrument of claim 11, wherein said switch comprises a shock sensitive switch.

14. The virtual musical instrument of claim 1, wherein said switch comprises a shock sensitive switch.

15. The virtual musical instrument of claim 1, wherein said switch comprises a contact switch.

16. A virtual musical instrument comprising:

a hand-held accessory of a type that is intended to be brought into contact with a musical instrument so as to play that instrument, said hand-held accessory including a switch which, in response to said hand-held accessory being caused to strike another object by a person holding said hand-held accessory, generates an activation signal, said hand-held accessory selected from a group of accessories consisting of a guitar pick, a drum stick, and a glove that is worn when playing a keyboard;

an audio synthesizer;

a memory storing a sequence of notes data structures for a musical score, each of said notes data structures representing a note or notes within said musical score and having an identified location in time relative to the other notes in said sequence of notes data structures;

a timer; and a digital processor receiving said activation signal from said hand-held accessory and generating a control signal therefrom, said digital processor programmed to use said timer to measure a time at which said activation signal is generated, said digital processor programmed to use said measured time to select one of the notes data structures within said sequence of notes data structures, and and said digital processor programmed to generate said control signal, wherein said control signal causes said synthesizer to generate the note(s) represented by said selected notes data structure.

* * * * *